US010641156B2

(12) United States Patent
Koda et al.

(10) Patent No.: US 10,641,156 B2
(45) Date of Patent: May 5, 2020

(54) EXHAUST PIPE STRUCTURE

(71) Applicant: TOYOTA JIDOSHA KABUSHIKI KAISHA, Toyota-shi, Aichi-ken (JP)

(72) Inventors: Yasuhiko Koda, Toyota (JP); Toshio Murata, Toyota (JP); Shunsuke Niitani, Toyota (JP); Chikara Okawa, Toyota (JP); Hideki Fukushima, Okazaki (JP); Takeyuki Harada, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 294 days.

(21) Appl. No.: 15/788,190

(22) Filed: Oct. 19, 2017

(65) Prior Publication Data

US 2018/0119594 A1 May 3, 2018

(30) Foreign Application Priority Data

Nov. 1, 2016 (JP) ..... 2016-214574

(51) Int. Cl.

| | |
|---|---|
| ***F01N 13/04*** | (2010.01) |
| ***F01N 1/08*** | (2006.01) |
| ***F01N 13/18*** | (2010.01) |
| ***F01N 1/00*** | (2006.01) |
| ***F01N 13/08*** | (2010.01) |

(52) U.S. Cl.

CPC ..... *F01N 13/04* (2013.01); *F01N 1/00* (2013.01); *F01N 1/08* (2013.01); *F01N 13/08* (2013.01); *F01N 13/185* (2013.01); *F01N 13/1872* (2013.01); *F01N 13/1894* (2013.01); *F01N 2340/04* (2013.01)

(58) Field of Classification Search

CPC ..... F01N 1/08; F01N 13/04
USPC ..... 181/228
See application file for complete search history.

(56) References Cited

U.S. PATENT DOCUMENTS

| | | | | |
|---|---|---|---|---|
| 9,206,726 | B2 * | 12/2015 | Cuellar | F01N 13/08 |
| 10,393,002 | B2 * | 8/2019 | Sugi | F01N 1/083 |
| 2008/0163613 | A1 | 7/2008 | Mabuchi et al. | |
| 2010/0126799 | A1 | 5/2010 | Matsueda et al. | |
| 2010/0192558 | A1 | 8/2010 | Matsueda | |
| 2014/0353077 | A1 * | 12/2014 | Uchida | B62K 11/04 181/228 |

(Continued)

FOREIGN PATENT DOCUMENTS

| | | |
|---|---|---|
| CN | 200988425 Y | 12/2007 |
| CN | 101220762 A | 7/2008 |

(Continued)

*Primary Examiner* — Forrest M Phillips
(74) *Attorney, Agent, or Firm* — Oliff PLC

(57) ABSTRACT

An exhaust pipe structure includes an exhaust pipe, a branching portion including an inflow port, a first flow path, a second flow path, a first discharge port, and a second discharge port, a first muffler, a first pipe, a second muffler, and a second pipe. The second flow path is lower in position in an up-down direction of a vehicle than the first flow path at a downstream side part of the second flow path including at least a portion of the second discharge port. The second pipe is lower in position in the up-down direction of the vehicle at an upstream side part connected to the second discharge port than an upstream side part of the first pipe connected to the first discharge port.

4 Claims, 5 Drawing Sheets

(56) References Cited

U.S. PATENT DOCUMENTS

2015/0354438 A1* 12/2015 Shinpo ..... F01P 11/10
60/324

FOREIGN PATENT DOCUMENTS

| | | | |
|---|---|---|---|
| CN | 101501307 | A | 8/2009 |
| CN | 101795886 | A | 8/2010 |
| JP | H04-037829 | U | 3/1992 |
| JP | 2008-045464 | A | 2/2008 |
| JP | 2009-062882 | A | 3/2009 |
| JP | 2015-158149 | A | 9/2015 |
| KR | 10-2011-0093412 | A | 8/2011 |
| WO | 2008/018630 | A1 | 2/2008 |
| WO | 2009/031015 | A2 | 3/2009 |

* cited by examiner

EXHAUST PIPE STRUCTURE

INCORPORATION BY REFERENCE

The disclosure of Japanese Patent Application No. 2016-214574 filed on Nov. 1, 2016 including the specification, drawings and abstract is incorporated herein by reference in its entirety.

BACKGROUND

1. Technical Field

The present disclosure relates to an exhaust pipe structure.

2. Description of Related Art

Japanese Unexamined Patent Application Publication No. 2008-45464 (JP 2008-45464 A) discloses a structure including one submuffler, a pair of main mufflers, an exhaust pipe connected to the rear end portion of the submuffler, and a first pipe and a second pipe respectively connected to the main mufflers branching from the rear end portion of the exhaust pipe.

SUMMARY

In the structure in which exhaust gas from the exhaust pipe is circulated to each of the mufflers through the first pipe and the second pipe branching from the rear end portion of the exhaust pipe and inclined portions that have gradients rising toward the respective muffler sides are provided at the downstream side parts of the first pipe and the second pipe, in some cases, the following phenomenon occurs. That is, once the posture of a vehicle is inclined backward as a result of parking on a slope or the like in a state where condensed water resulting from condensation of the water vapor contained in the exhaust gas is accumulated in the exhaust pipe, the condensed water flows into the first pipe and the second pipe and the condensed water is accumulated in both of the inclined portions of the first pipe and the second pipe in some cases; and further, once the parking continues for long under a low temperature atmosphere with the condensed water accumulated in both of the inclined portions of the first pipe and the second pipe, the condensed water freezes and flow paths in both of the inclined portions of the first pipe and the second pipe are closed in some cases.

The present disclosure provides an exhaust pipe structure that is capable of suppressing closing of flow paths in both inclined portions of a first pipe and a second pipe through which exhaust gas from an exhaust pipe is circulated to respective mufflers.

An aspect of the present disclosure relates to an exhaust pipe structure including an exhaust pipe located below a floor panel of a vehicle to extend along a horizontal direction in side view of the vehicle, a branching portion including an inflow port, a first flow path, a second flow path, a first discharge port, and a second discharge port, a first muffler, a first pipe, a second muffler, and a second pipe. The exhaust pipe is configured to allow exhaust gas to flow from an engine toward the rear side of the vehicle. The inflow port is connected to the exhaust pipe and communicates with a rear end portion of the exhaust pipe. The first flow path is configured such that a part of the exhaust gas flowing in from the exhaust pipe through the inflow port is discharged from the first discharge port. The second flow path is configured such that a rest of the exhaust gas flowing in from the exhaust pipe through the inflow port is discharged from the second discharge port. The second flow path is lower in position in an up-down direction of the vehicle than the first flow path at a downstream side part of the second flow path including at least a portion of the second discharge port. The first pipe is connected to and communicates with the first muffler and the first discharge port of the branching portion and is configured such that the exhaust gas discharged from the first discharge port is circulated to the first muffler. The first pipe includes an inclined portion having a gradient rising toward the first muffler side in the up-down direction of the vehicle at a downstream side part connected to the first muffler. The second pipe is connected to and communicates with the second muffler and the second discharge port of the branching portion and is configured such that the exhaust gas discharged from the second discharge port is circulated to the second muffler. The second pipe includes an inclined portion having a gradient rising toward the second muffler side in the up-down direction of the vehicle at a downstream side part connected to the second muffler. The second pipe is lower in position in the up-down direction of the vehicle at an upstream side part connected to the second discharge port than an upstream side part of the first pipe connected to the first discharge port.

According to the aspect of the present disclosure, the exhaust pipe is located below the floor panel of the vehicle extends along the horizontal direction in side view of the vehicle. The exhaust gas flows from the engine toward the rear side of the vehicle through the exhaust pipe. The rear end portion of the exhaust pipe communicates with the inflow port of the branching portion. The exhaust gas flows into the branching portion from the exhaust pipe through the inflow port.

The part of the exhaust gas flowing in through the inflow port is discharged from the first discharge port through the first flow path of the branching portion. The rest of the exhaust gas flowing in through the inflow port is discharged from the second discharge port through the second flow path of the branching portion.

The exhaust gas discharged from the first discharge port flows to the first muffler through the first pipe communicating with the first discharge port. The exhaust gas discharged from the second discharge port flows to the second muffler through the second pipe having a first end portion communicating with the second discharge port.

In some cases, the water vapor that is contained in the exhaust gas circulating through the exhaust pipe is condensed as a result of a decline in temperature during the circulation through the exhaust pipe or the like, condensed water is generated in the exhaust pipe as a result of the condensation, and then the condensed water is accumulated in the exhaust pipe. In addition, once the posture of a vehicle is inclined backward because of parking on a slope or the like, the condensed water accumulated in the exhaust pipe flows to the branching portion.

According to the aspect of the present disclosure, the second flow path is lower in position than the first flow path at least at the downstream side part including the second discharge port. In addition, the second pipe is lower in position than the first pipe at the upstream side part including the first end portion.

Accordingly, the condensed water flowing to the branching portion intensively flows to the second pipe through the second flow path and the second discharge port and the condensed water is unlikely to flow to the first pipe. As a result, the condensed water is unlikely to be accumulated in the inclined portion of the first pipe having the gradient rising toward the second muffler side even when the condensed water is accumulated in the inclined portion of the second pipe having the gradient rising toward the first muffler side. Accordingly, closing of the inclined portion of the first pipe is suppressed even when the condensed water freezes and the inclined portion of the second pipe is closed as a result of long-term parking under a low temperature atmosphere. As a result, an exhaust path through the first pipe can be ensured for the exhaust gas.

According to the aspect of the present disclosure, closing of flow paths in both of the inclined portions of the first pipe and the second pipe can be suppressed as described above.

In the aspect of the present disclosure, the second pipe may be larger in axial length than the first pipe.

According to the aspect of the present disclosure, the capacity for the accumulation of the condensed water can be increased by the part of the second pipe that is lower in position than the first pipe being made longer than in a structure in which a pipe smaller in axial length than the first pipe is used as the second pipe. As a result, the condensed water is allowed to intensively flow to the second pipe even in a case where the amount of the condensed water accumulated in the exhaust pipe is large. Accordingly, closing of the inclined portion of the first pipe is suppressed even when the condensed water freezes and the inclined portion of the second pipe is closed as a result of long-term parking under a low temperature atmosphere.

Hence, according to the aspect of the present disclosure, closing of flow paths in both of the inclined portions of the first pipe and the second pipe can be suppressed even in a case where the amount of the condensed water accumulated in the exhaust pipe is large.

In the aspect of the present disclosure, the second pipe may be smaller in axial length than the first pipe.

Once the posture of a vehicle is inclined backward because of traveling on a slope or the like, the condensed water accumulated in the exhaust pipe flows to the branching portion. The condensed water flowing to the branching portion intensively flows to the second pipe lower in position than the first pipe at the upstream side part including the first end portion and the condensed water is unlikely to flow to the first pipe.

According to the aspect of the present disclosure, the pipe smaller in axial length than the first pipe is used as the second pipe. Accordingly, the capacity for the accumulation of the condensed water can be decreased by the part of the second pipe that is lower in position than the first pipe being made shorter than in the structure in which the pipe larger in axial length than the first pipe is used as the second pipe.

The sectional area of the flow path of the second pipe is likely to decrease when the condensed water intensively flows to the second pipe by the capacity of the second pipe for the accumulation of the condensed water being reduced as described above. The decrease in the sectional area of the flow path of the second pipe results in an increase in flow velocity of the exhaust gas passing above the condensed water in the second pipe. Accordingly, the condensed water can be allowed to flow (fly) to the second muffler even at a relatively low exhaust gas flow rate.

In the aspect of the present disclosure, the exhaust pipe may be provided with a heat exchanger.

The aspect of the present disclosure has the configuration described above, and thus has an excellent effect in suppressing closing of flow paths in both of the inclined portions of the first pipe and the second pipe.

BRIEF DESCRIPTION OF THE DRAWINGS

Features, advantages, and technical and industrial significance of exemplary embodiments of the present disclosure will be described below with reference to the accompanying drawings, in which like numerals denote like elements, and wherein.

DETAILED DESCRIPTION OF EMBODIMENTS

Hereinafter, an example of an embodiment of the present disclosure will be described based on accompanying drawings. The arrows RR, UP, and RH appropriately shown in each of the drawings represent the rear, upper, and right sides of a vehicle, respectively.

The "vehicle side view" that is used in the following description refers to a case where the vehicle is seen from a first side in the width direction of the vehicle toward a second side and includes a case where some of its component parts are seen through. The "vehicle plan view" that is used in the following description refers to a case where the vehicle is seen from the upper side of the vehicle toward its lower side and includes a case where some of its component parts are seen through. The "vehicle rear view" that is used in the following description refers to a case where the vehicle is seen from the rear side of the vehicle toward its front side and includes a case where some of its component parts are seen through.

Exhaust Pipe Structure

An exhaust pipe structure 10 according to the present embodiment will be described first.

Figure 1:
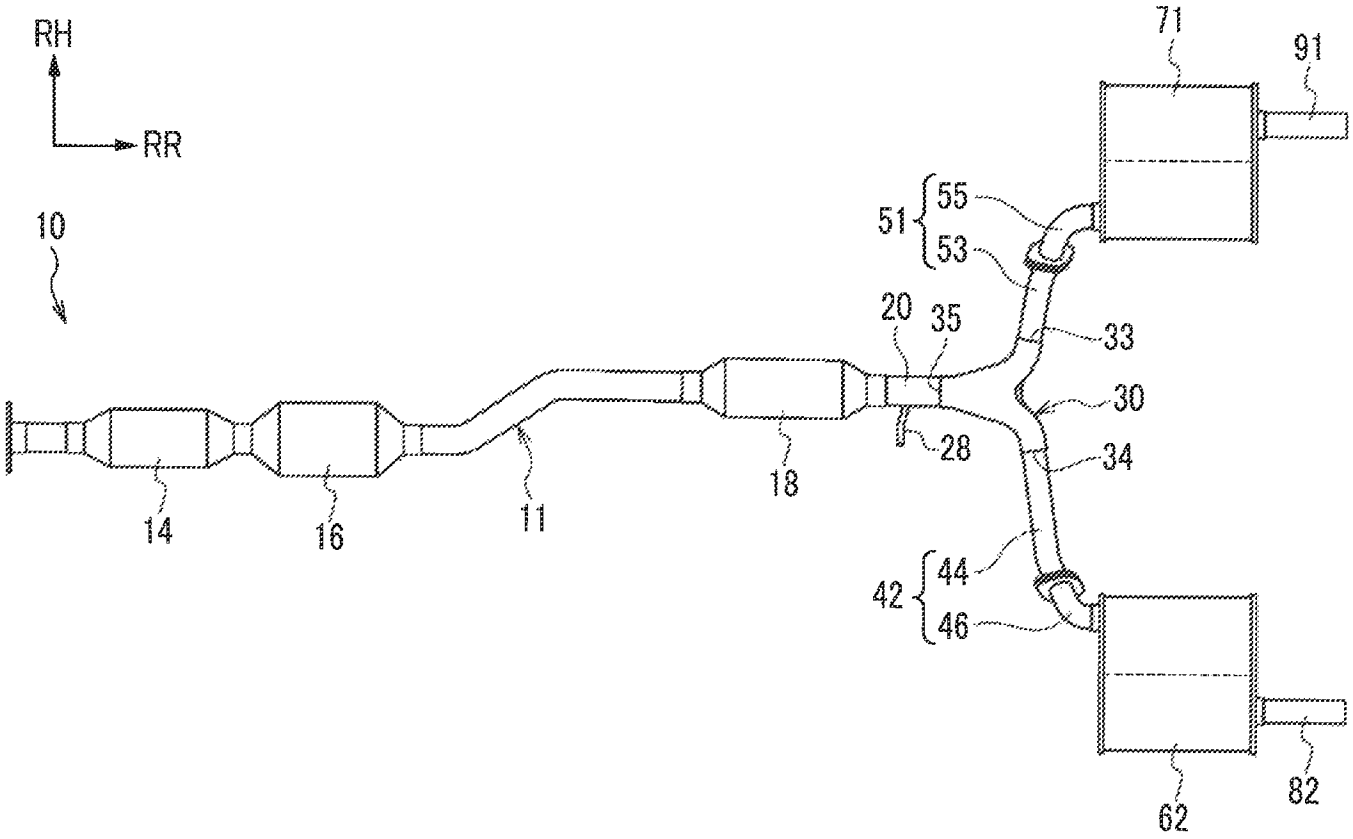
FIG. 1 is a plan view illustrating an exhaust pipe structure according to the present embodiment.
Figure 2:
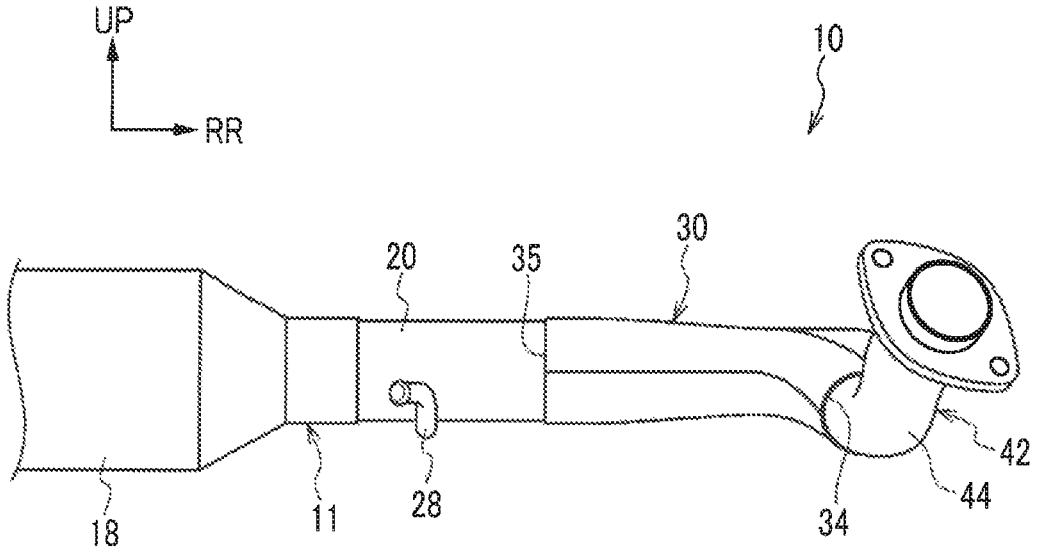
FIG. 2 is a side view illustrating a part of the exhaust pipe structure according to the present embodiment.
Figure 3:
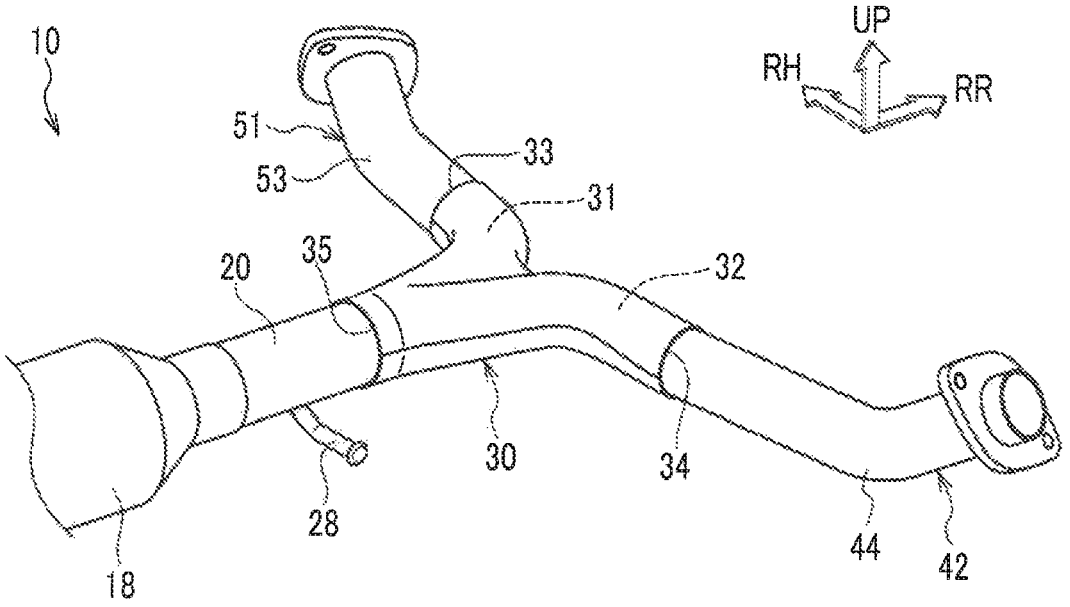
FIG. 3 is a perspective view illustrating a part of the exhaust pipe structure according to the present embodiment.
Figure 4:
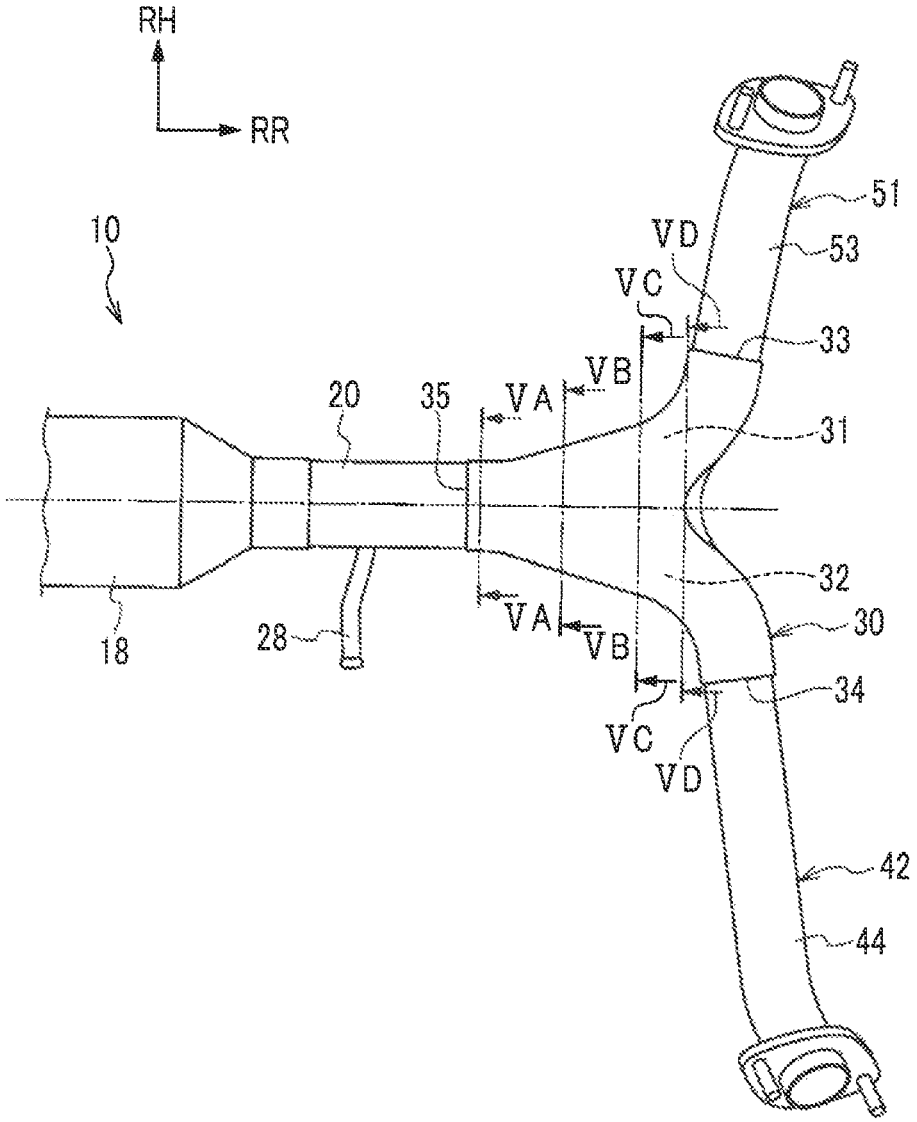
FIG. 4 is a plan view illustrating a part of the exhaust pipe structure according to the present embodiment.

FIG. 1 is a plan view illustrating the exhaust pipe structure 10. FIGS. 2 to 4 are a side view, a perspective view, and a plan view illustrating a part of the exhaust pipe structure 10, respectively. In each of the drawings including FIGS. 1 to 4, the structure is illustrated in a simplified manner for easy understanding of the exhaust pipe structure 10 according to the present embodiment.

The exhaust pipe structure 10 is a pipe structure for discharging the exhaust gas that is discharged from the engine (not illustrated) of the vehicle (automobile to be specific) to the atmosphere (to the outside of the vehicle). Specifically, the exhaust pipe structure 10 has a first exhaust pipe 11, a second exhaust pipe 20 (example of an exhaust pipe), a branching portion 30, a first pipe 51, a first main muffler 71 (example of a first muffler), a first discharge pipe 91, a second pipe 42, a second main muffler 62 (example of a second muffler), and a second discharge pipe 82 as illustrated in FIG. 1.

As illustrated in FIG. 1, the first exhaust pipe 11 is configured as a pipe that extends in the front-rear direction of the vehicle. The first exhaust pipe 11 has a front end portion that is connected to the engine (not illustrated). As a result, the exhaust gas from the engine flows in from the front end portion of the first exhaust pipe 11 and flows to the rear side of the vehicle (to the rear end portion of the first exhaust pipe 11).

A catalytic converter 14, an exhaust heat recovery unit 16, and a submuffler 18 are disposed on the first exhaust pipe 11 in this order from the front side of the vehicle. The catalytic converter 14 has a function to control the exhaust gas by removing certain substances from the exhaust gas passing through the catalytic converter 14.

The exhaust heat recovery unit 16 has a function to recover the heat of the exhaust gas and reuse the heat by performing heat exchange with a heat medium such as water. The submuffler 18 has a function to reduce the exhaust sound of the exhaust gas.

As illustrated in FIG. 2, the second exhaust pipe 20 is configured as a pipe that extends along the horizontal direction (front-rear direction of the vehicle) in vehicle side view. The second exhaust pipe 20 has a front end portion that communicates with the rear end portion of the first exhaust pipe 11. As a result, the exhaust gas from the first exhaust pipe 11 flows in from the front end portion of the second exhaust pipe 20 and flows to the rear side of the vehicle (to the rear end portion of the second exhaust pipe 20). A fixed member 28 (band) to be fixed to the body of the vehicle (such as its floor panel) is disposed on the second exhaust pipe 20. Each of the portions of the exhaust pipe structure 10 including the second exhaust pipe 20 is located below the floor panel of the vehicle.

As illustrated in FIG. 1, the second exhaust pipe 20 according to the present embodiment extends in the front-rear direction of the vehicle in vehicle plan view as well. The second exhaust pipe 20 can have any shape in vehicle plan view insofar as it extends in the front-rear direction of the vehicle in vehicle side view.

The branching portion 30 is a branching part where the single flow path through which the exhaust gas flows bifurcates into two. Specifically, the branching portion 30 has an inflow port 35, a first flow path 31, a second flow path 32, a first discharge port 33, and a second discharge port 34 as illustrated in FIGS. 3 and 4.

Figure 5A:
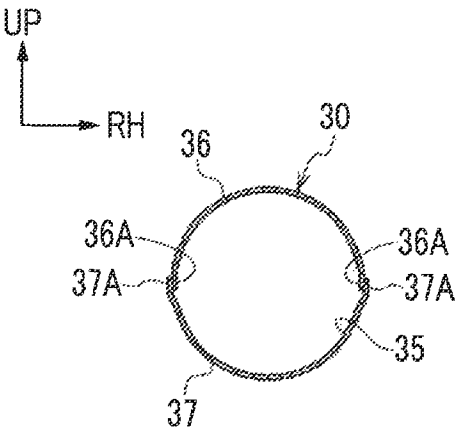
FIG. 5A is a front sectional view of a branching portion according to the present embodiment, which is a cross-sectional view taken along line VA-VA of FIG. 4.

The inflow port 35 is an inlet communicating with the rear end portion of the second exhaust pipe 20. The exhaust gas from the second exhaust pipe 20 flows into the inflow port 35. The first discharge port 33 and the second discharge port 34 are outlets and the exhaust gas flowing into the inflow port 35 is discharged through the first discharge port 33 and the second discharge port 34. As illustrated in FIG. 5A, the inflow port 35 is configured as an opening that has a substantially circular shape. Although not illustrated in the drawing, each of the first discharge port 33 and the second discharge port 34 is configured as an opening that has a substantially circular shape as is the case with the inflow port 35.

As illustrated in FIGS. 3 and 4, the first flow path 31 is a flow path through which a part of the exhaust gas flowing in from the second exhaust pipe 20 through the inflow port 35 is discharged from the first discharge port 33. The second flow path 32 is a flow path through which the rest of the exhaust gas flowing in from the second exhaust pipe 20 through the inflow port 35 (exhaust gas other than the exhaust gas discharged from the first discharge port 33) is discharged from the second discharge port 34. The inner diameter of the first flow path 31 is substantially equal to the inner diameter of the second flow path 32. The sectional area of the circulation space in the first flow path 31 through which the exhaust gas flows is substantially equal to the sectional area of the circulation space in the second flow path 32 through which the exhaust gas flows.

As illustrated in FIGS. 5A to 5D, the branching portion 30 has, for example, an upper member 36 constituting the upper portion of the branching portion 30 and a lower member 37 constituting the lower portion of the branching portion 30 and is configured by, for example, an end portion 36A of the upper member 36 and an end portion 37A of the lower member 37 being combined with each other. Each of the upper member 36 and the lower member 37 is configured as, for example, a press-molded plate.

Convex portions 38, 39 are formed in the middle portions of the upper member 36 and the lower member 37 in the width direction of the vehicle, respectively. The convex portions 38, 39 are partitions gradually partitioning the first flow path 31 and the second flow path 32 from each other. The formation of the convex portions 38, 39 ranges, for example, from a position in the branching portion 30 that is on the front side of the vehicle (position of line VB-VB in FIG. 4) to a position in the branching portion 30 that is on the rear side of the vehicle (position of line VD-VD in FIG. 4). In other words, the partitioning by the convex portions 38, 39 starts at a position on the front side of the vehicle and the starting position is the upstream end portions of the first flow path 31 and the second flow path 32. A part of the first flow path 31 and a part of the second flow path 32 communicate with each other between the position on the front side of the vehicle (position of line VB-VB in FIG. 4) and the position on the rear side of the vehicle (position of line VD-VD in FIG. 4).

Figure 5B:
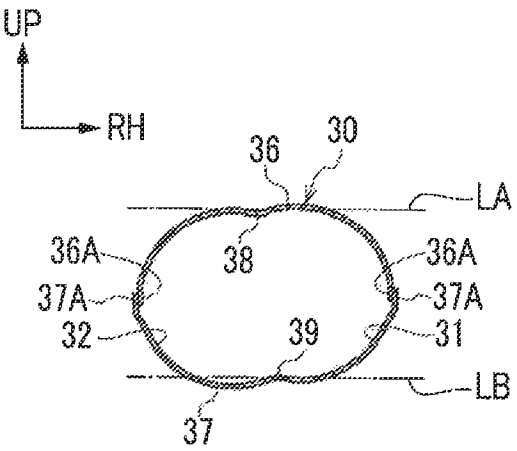
FIG. 5B is a front cross-sectional view of the branching portion according to the present embodiment, which is a cross-sectional view taken along line VB-VB of FIG. 4.
Figure 5C:
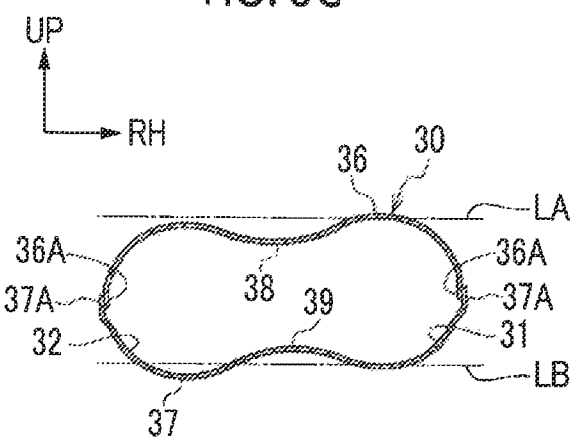
FIG. 5C is a front cross-sectional view of the branching portion according to the present embodiment, which is a cross-sectional view taken along line VC-VC of FIG. 4.
Figure 5D:
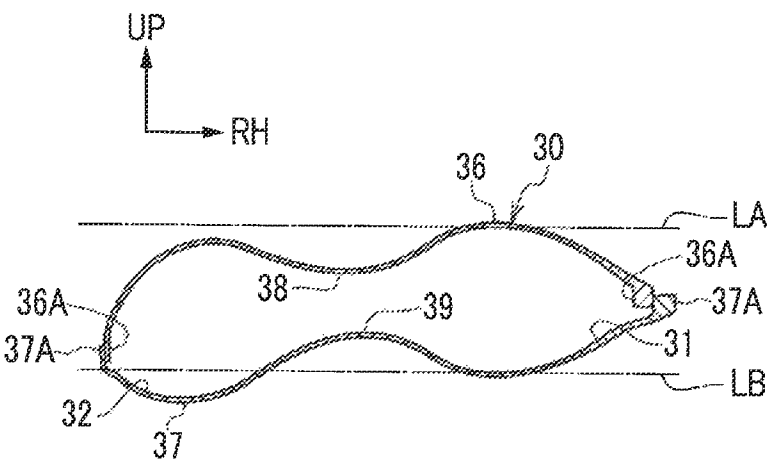
FIG. 5D is a front cross-sectional view of the branching portion according to the present embodiment, which is a cross-sectional view taken along line VD-VD of FIG. 4.

The amounts by which the convex portions 38, 39 protrude in the up-down direction of the vehicle gradually increase from the front side of the vehicle to the rear side of the vehicle (refer to FIGS. 5B to 5D). The first flow path 31 and the second flow path 32 are independent of each other on the downstream side of the position on the rear side of the vehicle (position of line VD-VD in FIG. 4).

As illustrated in FIG. 1, the first pipe 51 has an upstream pipe 53 constituting the upstream side part of the first pipe 51 and a downstream pipe 55 constituting the downstream side part of the first pipe 51. The upstream end portion (first end portion) of the upstream pipe 53 communicates with the first discharge port 33 of the branching portion 30. The downstream end portion (second end portion) of the upstream pipe 53 communicates with the upstream end portion (first end portion) of the downstream pipe 55.

Figure 6:
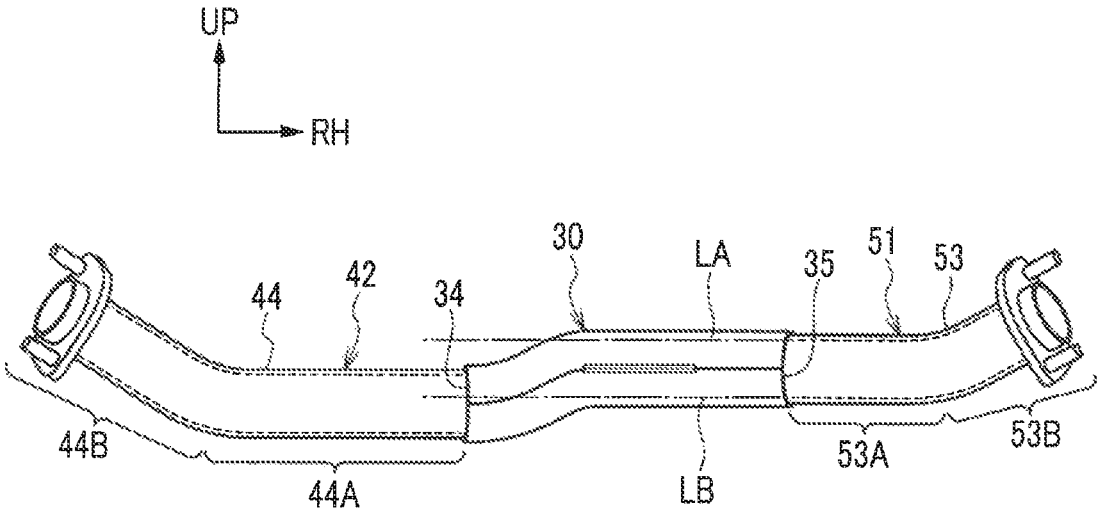
FIG. 6 is a rear view illustrating a part of the exhaust pipe structure according to the present embodiment.

As illustrated in FIG. 6, the upstream pipe 53 has a horizontal portion 53A and an inclined portion 53B. In vehicle rear view, the horizontal portion 53A extends along the width direction of the vehicle (horizontal direction) at the upstream side part including the upstream end portion of the upstream pipe 53. The inclined portion 53B has a rising gradient rising toward the right side of the vehicle, that is, the first main muffler 71 side (downstream side), at the downstream side part including the downstream end portion of the upstream pipe 53.

As illustrated in FIG. 1, the downstream end portion (second end portion) of the downstream pipe 55 communicates with the first main muffler 71. As a result, the exhaust gas discharged from the first discharge port 33 flows to the first main muffler 71 by the upstream pipe 53 and the downstream pipe 55 of the first pipe 51.

The exhaust gas circulating through the downstream pipe 55 flows into the first main muffler 71. The first main muffler 71 has a function to reduce the exhaust sound of the exhaust gas flowing into the first main muffler 71.

The first discharge pipe 91 extends from the first main muffler 71 to the rear side of the vehicle. The exhaust gas is discharged to the atmosphere from the first main muffler 71 through the first discharge pipe 91.

The second pipe 42 has an upstream pipe 44 constituting the upstream side part of the second pipe 42 and a downstream pipe 46 constituting the downstream side part of the second pipe 42. The inner diameter of the second pipe 42 is substantially equal to the inner diameter of the first pipe 51. The sectional area of the second pipe 42 is substantially equal to the sectional area of the first pipe 51. Each of the second pipe 42 and the first pipe 51 has a substantially constant inner diameter from its upstream end portion to its downstream end portion.

The upstream end portion (first end portion) of the upstream pipe 44 of the second pipe 42 communicates with the second discharge port 34 of the branching portion 30. The downstream end portion (second end portion) of the upstream pipe 44 communicates with the upstream end portion (first end portion) of the downstream pipe 46.

As illustrated in FIG. 6, the upstream pipe 44 has a horizontal portion 44A (example of the upstream side part) and an inclined portion 44B. In vehicle rear view, the horizontal portion 44A extends along the width direction of the vehicle (horizontal direction) at the upstream side part including the upstream end portion of the upstream pipe 44. The inclined portion 44B has a rising gradient rising toward the left side of the vehicle, that is, the second main muffler 62 side (downstream side), at the downstream side part including the downstream end portion of the upstream pipe 44.

As illustrated in FIG. 1, the downstream end portion (second end portion) of the downstream pipe 46 communicates with the second main muffler 62. As a result, the exhaust gas discharged from the second discharge port 34 flows to the second main muffler 62 by the upstream pipe 44 and the downstream pipe 46 of the second pipe 42.

The exhaust gas circulating through the downstream pipe 46 flows into the second main muffler 62. The second main muffler 62 has a function to reduce the exhaust sound of the exhaust gas flowing into the second main muffler 62.

The second discharge pipe 82 extends from the second main muffler 62 to the rear side of the vehicle. The exhaust gas is discharged to the atmosphere from the second main muffler 62 through the second discharge pipe 82.

In the present embodiment, the second flow path 32 in the branching portion 30 is lower in position than the first flow path 31 in the entire section that ranges from the upstream end portion (position of line VB-VB in FIG. 4) to the downstream end portion (second discharge port 34) as illustrated in FIGS. 5B to 5D and FIG. 6. In other words, the position of the bottom portion (lower end portion) of the circulation space in the second flow path 32 through which the exhaust gas flows is lower than the position of the bottom portion (lower end portion) of the circulation space in the first flow path 31 in each of the portions that range from the upstream end portion to the second discharge port 34 (refer to the one-dot chain line LB in FIGS. 5B to 5D).

In the present embodiment, the position of the top portion (upper end portion) of the circulation space in the second flow path 32 is also lower than the position of the top portion (upper end portion) of the circulation space in the first flow path 31 in each of the portions that range from the upstream end portion to the second discharge port 34 (refer to the one-dot chain line LA in FIGS. 5B to 5D). The position of the top portion (upper end portion) of the circulation space in the second flow path 32 may be the same as or higher than the position of the top portion (upper end portion) of the circulation space in the first flow path 31.

In the present embodiment, in addition, the upstream pipe 44 of the second pipe 42 is lower in position than the upstream pipe 53 of the first pipe 51 in the horizontal portion 44A as illustrated in FIG. 6. In other words, the position of the bottom portion (lower end portion) of the circulation space in the upstream pipe 44 through which the exhaust gas flows is lower than the position of the bottom portion (lower end portion) of the circulation space in the upstream pipe 53 in the horizontal portion 44A (refer to the one-dot chain line LB in FIG. 6).

In the present embodiment, the position of the top portion (upper end portion) of the circulation space in the upstream pipe 44 is also lower than the position of the top portion (upper end portion) of the circulation space in the upstream pipe 53 in the horizontal portion 44A (refer to the one-dot chain line LA in FIG. 6). The position of the top portion (upper end portion) of the circulation space in the upstream pipe 44 may be the same as or higher than the position of the top portion (upper end portion) of the circulation space in the upstream pipe 53.

In the present embodiment, a pipe larger in axial length than the first pipe 51 is used as the second pipe 42 (refer to FIG. 1). Specifically, the axial length of the horizontal portion 44A of the upstream pipe 44 of the second pipe 42 exceeds the axial length of the horizontal portion 53A of the upstream pipe 53 of the first pipe 51 (refer to FIG. 6). The axial length is the length of the pipe in its axial direction.

Actions and Effects of Exhaust Pipe Structure

Hereinafter, actions and effects of the exhaust pipe structure 10 will be described.

In the exhaust pipe structure 10, the exhaust gas discharged from the engine (not illustrated) flows to the rear side of the vehicle by passing through the first exhaust pipe 11, the second exhaust pipe 20, and the branching portion 30 in this order. Then, the part of the exhaust gas is discharged to the atmosphere through the first pipe 51, the first main muffler 71, and the first discharge pipe 91 and the rest of the exhaust gas is discharged to the atmosphere through the second pipe 42, the second main muffler 62, and the second discharge pipe 82 (refer to FIG. 1).

In some cases, the water vapor that is contained in the exhaust gas circulating through the first exhaust pipe 11 and the second exhaust pipe 20 is condensed as a result of a decline in temperature during the circulation through the first exhaust pipe 11 and the second exhaust pipe 20 or the like, condensed water is generated in the first exhaust pipe 11 and the second exhaust pipe 20 as a result of the condensation, and then the condensed water is accumulated in the first exhaust pipe 11 and the second exhaust pipe 20. In the present embodiment, in particular, the condensation of the water vapor is likely to occur because the temperature of the exhaust gas is lowered by the heat of the exhaust gas being recovered by the exhaust heat recovery unit 16.

Once the posture of a vehicle is inclined backward because of parking on a slope or the like, the condensed water accumulated in the first exhaust pipe 11 and the second exhaust pipe 20 flows to the branching portion 30.

In the exhaust pipe structure 10, the second flow path 32 is lower in position than the first flow path 31 in the entire section that ranges from the upstream end portion (position of line VB-VB in FIG. 4) to the downstream end portion (second discharge port 34) as illustrated in FIGS. 5B to 5D and FIG. 6. The upstream pipe 44 of the second pipe 42 is lower in position than the upstream pipe 53 of the first pipe 51 in the horizontal portion 44A as illustrated in FIG. 6.

Accordingly, the condensed water flowing to the branching portion 30 intensively flows to the second pipe 42 through the second flow path 32 and the second discharge port 34 and the condensed water is unlikely to flow to the first pipe 51. As a result, the condensed water is unlikely to be accumulated in the inclined portion 53B of the upstream pipe 53 of the first pipe 51 even when the condensed water is accumulated in the inclined portion 44B of the upstream pipe 44 of the second pipe 42. Accordingly, closing of the inclined portion 53B of the upstream pipe 53 is suppressed even when the condensed water freezes and the inclined portion 44B of the upstream pipe 44 is closed as a result of long-term parking under a low temperature atmosphere. As a result, an exhaust path through the first pipe 51 can be ensured for the exhaust gas.

With the exhaust pipe structure 10, closing of flow paths in both of the inclined portions 44B, 53B of the first pipe 51 and the second pipe 42 can be suppressed as described above.

In the exhaust pipe structure 10, the pipe larger in axial length than the first pipe 51 is used as the second pipe 42 (refer to FIG. 1). Accordingly, the capacity for the accumulation of the condensed water can be increased by the part of the second pipe 42 that is lower in position than the first pipe 51 being made longer than in a structure in which a pipe smaller in axial length than the first pipe 51 is used as the second pipe 42. In the present embodiment, the axial length of the horizontal portion 44A as the part that is lower in position than the first pipe 51 exceeds the axial length of the horizontal portion 53A of the upstream pipe 53 of the first pipe 51.

As a result, the condensed water is allowed to intensively flow to the second pipe 42 even in a case where the amount of the condensed water accumulated in the second exhaust pipe 20 is large. Accordingly, closing of the inclined portion 53B of the upstream pipe 53 is suppressed even when the condensed water freezes and the inclined portion 44B of the upstream pipe 44 is closed as a result of long-term parking under a low temperature atmosphere.

Accordingly, with the exhaust pipe structure 10, closing of flow paths in both of the inclined portions 44B, 53B of the first pipe 51 and the second pipe 42 can be suppressed even in a case where the amount of the condensed water accumulated in the second exhaust pipe 20 is large.

Modification Example

In the present embodiment, the second flow path 32 is lower in position than the first flow path 31 in the entire section that ranges from the upstream end portion (position of line VB-VB in FIG. 4) to the downstream end portion (second discharge port 34). The applicable embodiment of the present disclosure is not limited thereto. The second flow path 32 may be lower in position than the first flow path 31 at the downstream side part including at least the second discharge port 34. Accordingly, the second flow path 32 may be configured to, for example, have the same height as the first flow path 31 in the upstream end portion (position of line VB-VB in FIG. 4) and be lower in position than the first flow path 31 in the section that ranges from the intermediate portion in the direction of the circulation (position of line VB-VB in FIG. 4) to the downstream end portion (second discharge port 34).

In the present embodiment, the pipe larger in axial length than the first pipe 51 is used as the second pipe 42. The applicable embodiment of the present disclosure is not limited thereto. A pipe equal in axial length to the first pipe 51 may be used as the second pipe 42.

In addition, the pipe smaller in axial length than the first pipe 51 may be used as the second pipe 42. In the structure, the capacity for the accumulation of the condensed water can be decreased by the part of the second pipe 42 that is lower in position than the first pipe 51 being made shorter than in the structure in which the pipe larger in axial length than the first pipe 51 is used as the second pipe 42.

Once the posture of a vehicle is inclined backward because of traveling on a slope or the like, the condensed water accumulated in the second exhaust pipe 20 flows to the branching portion 30. The condensed water flowing to the branching portion 30 intensively flows to the second pipe 42 lower in position than the first pipe 51 in the upstream pipe 44 and the condensed water is unlikely to flow to the first pipe 51.

Accordingly, the sectional area of the flow path of the second pipe 42 is likely to decrease when the condensed water intensively flows to the second pipe 42 by the capacity of the second pipe 42 for the accumulation of the condensed water being reduced. The decrease in the sectional area of the flow path of the second pipe 42 results in an increase in flow velocity of the exhaust gas passing above the condensed water in the second pipe 42. Accordingly, the condensed water can be allowed to flow (fly) to the second main muffler 62 even at a relatively low exhaust gas flow rate.

The applicable embodiment of the present disclosure is not limited to the embodiment described above. The present disclosure can be modified, changed, and improved in various ways without departing from the scope of the present disclosure.

What is claimed is:

1. An exhaust pipe structure comprising:

an exhaust pipe located below a floor panel with respect to a vertical direction of a vehicle and extending along a horizontal direction in a side view of the vehicle, the exhaust pipe being configured to guide an exhaust gas to flow from an engine of the vehicle toward a rear side of the vehicle;

a branching portion configured to bisect the exhaust gas pipe such that the flow of exhaust gas is divided into a first portion and a second portion, the branching portion including:

an inflow port connected to the exhaust pipe and communicating with a rear end portion of the exhaust pipe;

a first discharge port;

a first flow path configured such that the first portion of the exhaust gas flowing from the exhaust pipe through the inflow port is discharged from the first discharge port;

a second discharge port; and a second flow path configured such that the second portion of the exhaust gas flowing from the exhaust pipe through the inflow port is discharged from the second discharge port, the second flow path being directed in a direction that is angled downward in the vertical direction of the vehicle relative to a direction of the first flow path at a downstream side part of the second flow path;

a first muffler;

a first pipe communicating with the first muffler and the first discharge port of the branching portion, the first pipe being configured to guide the exhaust gas discharged from the first discharge port to the first muffler, the first pipe including an inclined portion having a gradient rising toward a first muffler side in the vertical direction of the vehicle at a downstream side part of the first pipe connected to the first muffler;

a second muffler; and a second pipe communicating with the second muffler and the second discharge port of the branching portion, the second pipe being configured to guide the exhaust gas discharged from the second discharge port to the second muffler, the second pipe including an inclined portion having a gradient rising toward a second muffler side in the vertical direction of the vehicle at a downstream side part of the second pipe connected to the second muffler, the second pipe being lower in the vertical direction of the vehicle at an upstream side part connected to the second discharge port than an upstream side part of the first pipe connected to the first discharge port.

2. The exhaust pipe structure according to claim 1, wherein the second pipe is greater in axial length than the first pipe.

3. The exhaust pipe structure according to claim 1, wherein the second pipe is shorter in axial length than the first pipe.

4. The exhaust pipe structure according to claim 1, wherein the exhaust pipe includes a heat exchanger.

* * * * *